United States Patent [19]

Nickles, Jr.

[11] Patent Number: 4,661,020

[45] Date of Patent: Apr. 28, 1987

[54] LEG CLOSURE—IMPROVED FABRIC LAYUP

[75] Inventor: Robert B. Nickles, Jr., Duncan, Okla.

[73] Assignee: Halliburton Company, Duncan, Okla.

[21] Appl. No.: 889,133

[22] Filed: Jul. 23, 1986

[51] Int. Cl.[4] ..... E02D 5/52

[52] U.S. Cl. ..... 405/227; 138/89; 405/225

[58] Field of Search ..... 405/195, 224–227; 156/123, 132; 152/548, 546, 552, 553, 558, 560, 554, 563; 138/89

[56] References Cited

U.S. PATENT DOCUMENTS

| | | | |
|---|---|---|---|
| 1,584,284 | 5/1926 | Grabau | 152/553 X |
| 3,286,758 | 11/1966 | Svereckis et al. | 152/554 |
| 3,533,241 | 10/1970 | Bowerman et al. | 405/227 X |
| 4,178,112 | 12/1979 | Knox | 405/227 |
| 4,220,422 | 9/1980 | Sullaway | 405/225 |
| 4,230,424 | 10/1980 | Sullaway | 405/225 X |
| 4,367,983 | 1/1983 | Streich | 405/225 X |
| 4,470,726 | 9/1984 | Helms | 405/227 |
| 4,576,522 | 3/1986 | Freeman | 405/225 |

*Primary Examiner*—Dennis L. Taylor

*Attorney, Agent, or Firm*—Joseph A. Walkowski

[57] ABSTRACT

The ply overlap arrangement of the present invention comprises alternating the orientation or overlap direction of each ply of fabric strips with respect to a section of the peripheral reinforcing member so that each successive overlap end of strip is wrapped in the opposite direction from and falls on the opposite side of the reinforcing member from the preceding ply overlap end. Each overlap end is of sufficient length to extend back toward the center of the primary load carrying portion of the strips of the preceding ply. This arrangement, by extending the overlap ends back over the preceding ply of primary load carrying strips, ensures not only that an overlap of a strip will never be bonded to another ply overlap, but that each overlap will be bonded over a large area on one or both sides to a preceding ply of primary load carrying strips extending across the face of the closure or diaphragm.

11 Claims, 4 Drawing Figures

LEG CLOSURE—IMPROVED FABRIC LAYUP

BACKGROUND OF THE INVENTION

This invention relates to an improved closure or diaphragm for offshore platforms used in well drilling and production.

Offshore platforms are generally fabricated in a harbor or on a shore location and are then towed to a marine site where they are tipped on end and lowered into position with the platform resting on the ocean floor. The platform legs are hollow structures having open ends so that pilings can be driven downwardly through the legs into the subterranean formations below the ocean floor to anchor the platform into position.

It is desirable during platform setting operations to utilize the platform legs and/or pile sleeves for bouyancy to assist in the setting operations. It is also desirable to exclude foreign material from the platform leg and/or pile sleeve during platform setting operations to prevent the annulus between the piling and the platform leg and/or pile sleeve from becoming contaminated with foreign material which would prevent the filling of the annulus with cement or grout. Therefore, a closure structure which is easily severable when the piling is driven through the platform leg and/or pile sleeve is used to seal the end of the platform leg and/or pile sleeve during setting of the platform.

Typical prior art closure structures, generally referred to as closures or diaphragms, utilized to seal the end of a platform and/or pile sleeve of an offshore platform, are illustrated in U.S. Pat. Nos. 3,533,241, 4,024,723, 4,178,112, 4,220,422, and 4,230,424. While these closures are generally satisfactory, all utilize layers or plies of reinforcing material comprised of unitary pieces of fabric to cover the closure.

Another prior art closure or diaphragm shown in U.S. Pat. No. 4,367,983, utilizes layers or plies of reinforcing material comprised of strips of fabric where each strip is oriented with respect to another strip in the same layer or ply and with another in an adjacent layer or ply such that the number of longitudinal threads of the fabric of the strips of each layer or ply generally extend along radial lines in a horizontal plane of the closure.

Yet another prior art closure or diaphragm, also utilizing layers or plies of reinforcing material comprised of strips of fabric is disclosed in U.S. Pat. No. 4,470,726. Unlike the closure or diaphragm disclosed in U.S. Pat. No. 4,367,983, the latter closure or diaphragm comprises a plurality of strips of fabric, at least one strip of fabric having the ends wrapped and secured about one or more reinforcing members in the outer periphery of the closure or diaphragm and covering the center of the closure or diaphragm and the remaining strips of fabric having each end thereof wrapped and secured about one or more reinforcing members in the outer periphery and extending along lines which are chords of a circle formed by a reinforcing member such that the closure or diaphragm has each area thereof reinforced by at least one strip of fabric.

While the closures or diaphragms shown in both U.S. Pat. Nos. 4,367,983 and 4,470,726 are believed to constitute improvements over the closures or diaphragms employing unitary pieces of fabric as disclosed in the previously mentioned patents, such closures or diaphragms still suffer from problems resulting from the manner in which the strips of fabric are overlapped around a peripheral reinforcing member at the outer edge of the closure or diaphragm. Specifically, the prior art method of overlapping fabric about a peripheral reinforcing member or shim results in all of the fabric overlaps being on one side ("side" referring in this instance to the top or bottom) of the reinforcing member and all of the primary load carrying strips extending across the face of the closure or diaphragm being on the other side of the reinforcing member. This is particularly evident in the '726 patent, wherein only one reinforcing member is employed. However, the same disadvantage obtains with the '983 patent, wherein two reinforcing members are employed but the fabric strip overlaps still remain on one side of a reinforcing member, while the primary load carrying strips remain on the other side of that reinforcing member. With either prior art design, the overlap arrangement causes the reinforcing member to twist when the closure or diaphragm is stressed. This twisting moment, or torque, occurs because the horizontal force exerted by the fabric strips on the reinforcing member does not lie in the same horizontal plane as the center line of the reinforcing member. In some instances, this torque is great enough to permanently deform the reinforcing member when the closure or diaphragm is pressure tested, making it extremely difficult to assemble the closure or diaphragm with the annular flanges used to secure same to the bottom of a platform leg or pile sleeve and align the bolts extending through the closure or diaphragm with the flanges on either side thereof in order to clamp the edge of the closure or diaphragm between the aforesaid flanges. An additional problem of the prior art overlap arrangement, due to the fact that all of the overlaps about a reinforcing member are all on the same side thereof, is that the overlap bond to the primary loading carrying strips sometimes fails or pulls loose when the closure is pressure tested. This phenomenon occurs because the bond area between the first, or innermost overlaps and the primary strips is relatively small, and each successive overlap layer wrapped around the reinforcing member over the first overlaps is bonded primarily to the first or another preceding overlap and not to a primary load carrying strip.

The aforementioned U.S. Pat. No. 3,533,241, which employs unitary plies of reinforcing material rather than the preferred strip-type plies of the '983 and '726 patents, does employ an alternating wrapping direction for each successive ply about a peripheral reinforcing member. However, the overlap edges of these unitary plies are not extended back over the face of the diaphragm, so that the ply/ply bond area is severely limited and takes place about a reinforcing member of round cross-section, precluding any assurance of continuous contact (no voids) between adjacent plies and subjecting the arcuate ply/ply bond areas to different shear loads in the bond area when the closure or diaphragm is tested or used, due to the varying diameters of the overlapped ply edges. Furthermore, the non-extension of the overlap edges back over the face of the diaphragm means that the number of plies inward of the reinforcing member is limited to the number extending across the diaphragm face even in the high stress area immediately inward of and adjacent to the reinforcing member. In addition, the round cross-sectional shape of the reinforcing member requires costly grooved plates to secure the diaphragm to the platform legs, and the close proximity of the overlapped edges to the outside edge of the diaphragm increases the risk that the plies at that location will be pinched or cut when the diaphragm is press-cured secured between the aforesaid plates.

SUMMARY OF THE INVENTION

In contrast to the prior art overlap arrangement employed in closures or diaphrams, the ply overlap arrangement of the present invention comprises alternating the orientation or overlap direction of each ply of fabric strips with respect to a section of the peripheral reinforcing member so that each successive overlap end of a strip is wrapped in the opposite direction from and falls on the opposite side of the reinforcing member from the preceding ply overlap end. Further, each overlap end is of sufficient length to extend back toward the center of the primary load carrying portion of the strips of the preceding ply. Alternating the ply overlaps in this manner puts the resultant horizontal forces exerted on the reinforcing member substantially in the same horizontal plane as the center line thereof. This minimizes or eliminates the twisting moment that the reinforcing member "sees" when the closure or diaphragm is stressed. Also, this arrangement, by extending the overlap ends back over the preceding ply of primary load carrying strips, ensures not only that an overlap of a strip will never be bonded to another ply overlap, but that each overlap will be bonded over a large area on one or both sides to a preceding ply of primary load carrying strips extending across the face of the closure or diaphragm. Because of this feature, bond failure at the overlaps is greatly reduced if not eliminated, allowing the full tensile strength of the fabric to be utilized, unconstrained by the single, weak overlap/primary strip bond area inherent in prior art designs.

BRIEF DESCRIPTION OF THE DRAWINGS

The advantages of the preferred embodiment of the present invention will be more fully understood from the following specification taken in conjunction with the accompanying drawings, wherein.

DETAILED DESCRIPTION OF THE PREFERRED EMBODIMENT

Figure 1:
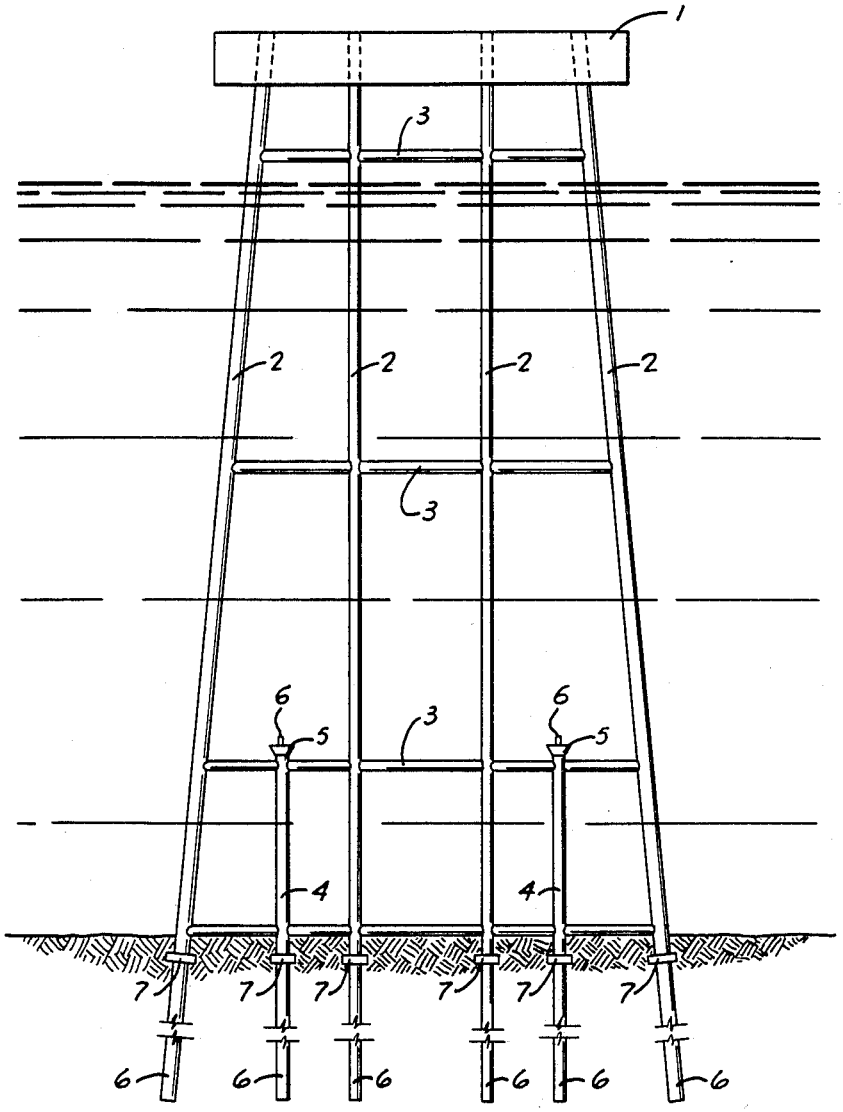
FIG. 1 is a side elevational view of a marine platform having tubular supporting legs and piling guide sleeves between the legs resting on the bottom of a body of water with a closure or diaphragm including the overlap arrangement of the present invention installed on the lower the legs and sleeves.

Referring to FIG. 1, closures or diaphragms employing the overlap arrangement of the present invention are shown installed on a marine platform. A marine platform 1 is shown having tubular supporting legs 2 between which horizontal reinforcing members 3 are connected in the usual manner. Tubular piling guide sleeves 4, which may have flared upper ends 5, are supported between the lower end portion of the legs 2 by the lower reinforcing members 3 and, with the legs, are adapted to rest upon or have their lower extremities embedded in the bottom of a body of water.

The sleeves 4 and legs 2 are secured to the earth by driving a piling 6 to refusal or to a predetermined depth into the bottom of the body of water. Upon completion of the pile driving, the annulus between each sleeve 4 and/or leg 2 and its associated pilings 6 may be filled with cement or grout or bonded by any suitable means to provide a unitary base structure. Contained on the bottom of each leg 2 and guide 4 is a rupturable seal assembly 7 which employs the principles of the present invention.

Figure 2:
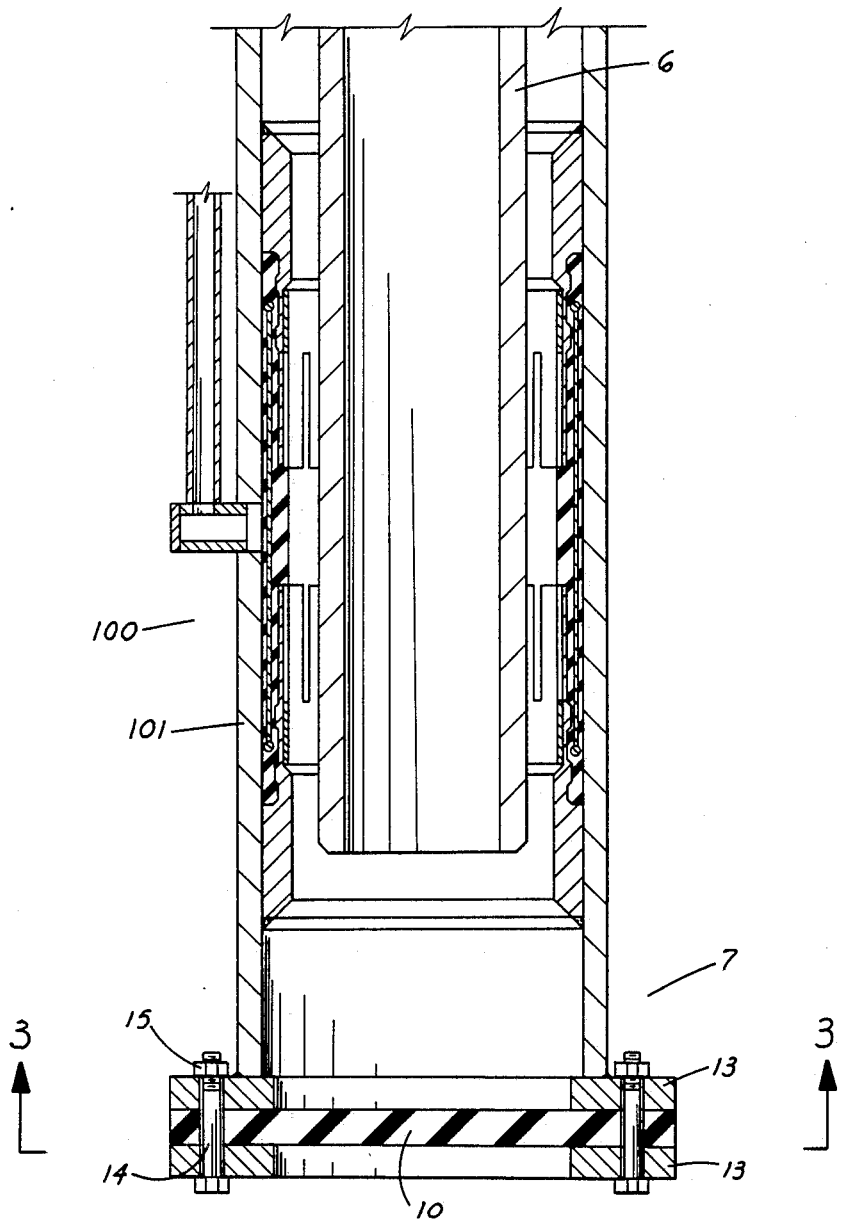
FIG. 2 is a cross-sectional view of a closure or diaphragm in a typical installation in a leg or piling guide sleeve.

Referring to FIG. 2, the seal assembly 7 is shown in relation to an inflatable packer assembly 100 installed at the bottom of a leg 2 or guide sleeve 4. As shown, the closure or diaphragm 10 is relatively thin compared to its diameter. For mounting the seal assembly 7 on the lower end of the inflatable packer assembly 100, a pair of flat annular plates 13 is provided with the plates 13 being adapted to be releasably secured to each other about their outer periphery by a plurality of bolts 14 and nuts 15. The bolts 14 also extend through the outer periphery of the closure or diaphragm 10 having at least one annular metal reinforcing member 12 therein (not shown). The upper annular plate 13 is adapted to be secured to the lower end of the packer housing 101 by welding, although any suitable means of securing the plate 13 may be used. If no inflatable packer is installed on the bottom of the leg 2 or guide sleeve 4, alternatively, the plate 13 may be secured to the bottom of leg 2 or guide sleeve 4. As shown, the seal assembly closes the lower end of the inflatable packer assembly 100, which is secured to a leg 2 or guide sleeve 4 through which a piling is to be driven to facilitate floating of the platform to its point of installation, as well as preventing the entrance of silt and other debris into the leg 2 or guide sleeve 4 during the installation of the platform. To position the platform legs 2 and guide sleeves 4 on the bottom of the body of water, it is necessary to waterflood some or all of the legs 2 or guide sleeves 4. After rupturing of the closure or diaphragm 10 by the piling 6 being driven into the bottom, the closure or diaphragm 10 and the water located thereabove acts to help prevent entry of foreign material into the leg 2 or guide sleeve 4, although during driving of the piling 6, an amount of foreign material will be introduced into the leg 2 or guide sleeve 4. Although not shown, the closure or diaphragm 10 may be secured to the jacket leg or pile sleeve of the platform by means of two annular plates having flat confronting faces with inwardly tapered enlarged ends to retain the closure or diaphragm therebetween by means of an interference fit therewith.

Figure 3:
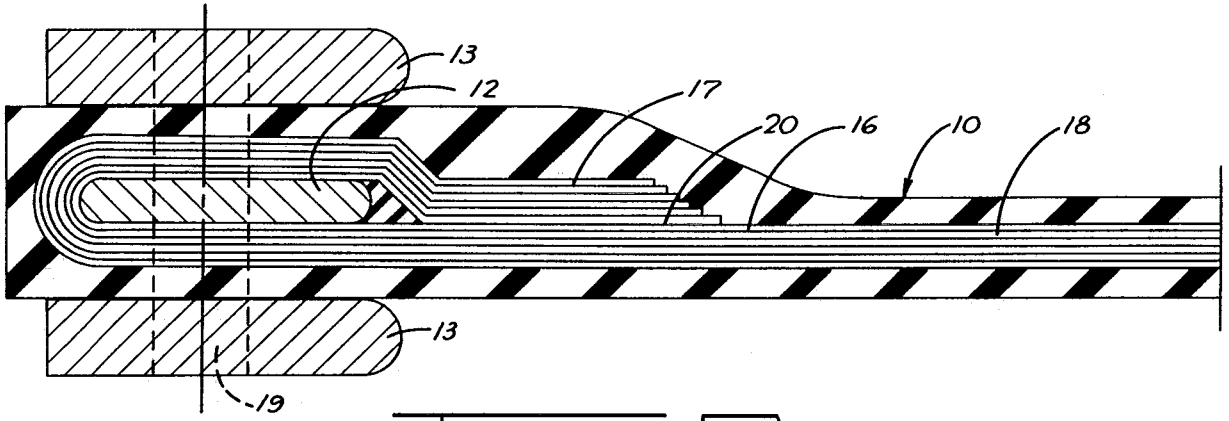
FIG. 3 PRIOR ART
FIG. 3 is an enlarged cross-sectional view of an outer edge of a closure or diaphragm employing the strip overlap arrangement of the prior art, as disclosed in U.S. Pat. No. 4,470,726.

Referring to FIG. 3, an enlarged cross-sectional view of the outer or peripheral extent of a closure or diaphragm employing the ply overlap arrangement of the prior art, as disclosed in U.S. Pat. No. 4,470,726, is shown. The closure or diaphragm 10 comprises a flexible member of rubber, synthetic rubber or other suitable elastomeric material. To reinforce the closure 10, a plurality of plies 16, each formed by a plurality of strips of fabric laid in a pattern, are bonded or secured within the closure 10 with the outer ends of the strips at the periphery of the plies 16 of fabric being wrapped about one or more annular reinforcing members 12 in the same direction from the same side thereof as preceding ends of preceding plies and bonded or secured thereto in a manner well known in the art. The "overlap" strip ends 17 of the plies 16 of fabric extend back into the inner portion of the closure 10 after passing around the outer edge of reinforcing member 12 as shown in FIG. 3 in a stacked or parallel relationship adjacent the stack of the primary load carrying strip portions 18 of the plies 16 extending across the face of the closure of diaphragm. Any number of plies 16 of fabric strips may be used to reinforce the closure 10 depending on the desired strength of the closure. The strips of fabric used to reinforce the closure 10 may be of any suitable material, such as rayon, nylon, polyester, steel, a fabric sold under the trademark Kevlar by the DuPont Company, although polyester fabric is preferred. These strips are covered with a coating of rubber or "calendared," are coated with any suitable commercially available bonding agent before being laid in the desired pattern for the closure or diaphragm reinforcement, and bonded to the flexible member, to reinforcing member 12 and to adjacent strip areas during the "curing" of the closure or diaphragm in an autoclave, a procedure well known in the art. As shown in FIG. 2 of the drawings, when the closure 10 is installed on a jacket leg 2 or pile sleeve 4, holes 19 (see FIG. 3) extend through the outer periphery of the closure passing through the elastomeric material, the annular metal reinforcing member 12 and the plies 16 wrapped and secured about the member 12. As noted previously, bolts 14 are disposed through holes 19 and, with cooperating nuts 15, clamp closure 10 between plates 13.

Plates 13, as well as annular metal reinforcing member 12, may be of any suitable material, although steel is preferred.

The manner in which the strips of fabric may be laid up to form each ply 16 of a reinforcing means for closure 10 is well known in the art, and two variations thereof are specifically illustrated in the aforementioned U.S. Pat. Nos. 4,367,983 and 4,470,726, both assigned to Halliburton Company, assignee of the present invention, and hereby incorporated herein by reference. Consequently, no further description of the fabric strip layup method will be made, except as it pertains specifically to the overlap arrangement of the present invention.

Referring again to FIG. 3, it will readily be noted that the placement of all of the primary load carrying strips 18 of plies 16 under reinforcing member 12, and all of the overlap strip ends 17 over reinforcing member 12 (or vice versa) results in the horizontal tensile force applied to the load carrying strip portions 18 during closure or diaphragm testing being offset from the horizontal centerline of reinforcing member 12, thus twisting member 12 due to the twisting moment or torque arising from the offset manner in which this force is applied. It will also be appreciated that the sole bond between the overlap strip ends 17 and the primary load carrying strip portions 18 lies in a single area 20 between the innermost overlap end 17 and primary load carrying strip portion 18. All other strip to strip bonds are between adjacent overlap ends or between adjacent primary load carrying strips. As a result it is not uncommon for the bond at 20 to fail or pull loose during closure or diaphragm testing. Even if both problems, of reinforcing member twisting and overlap end/primary load carrying strip bond failure, do not manifest themselves by perceptible signs during a test, sufficient damage may still be done to cause failure after installation on a platform.

Figure 4:
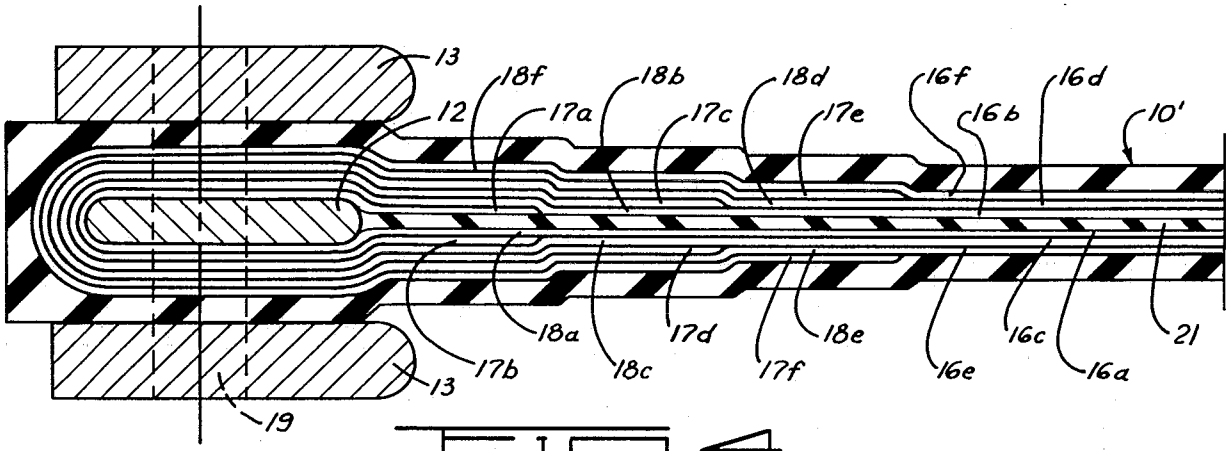
FIG. 4 is an enlarged cross-sectional view of an outer edge of a closure or diaphragm employing the strip overlap arrangement of the present invention.

Referring now to FIG. 4 of the drawings, the ply overlap arrangement of the present invention will be described in detail, using the same reference numerals as in FIG. 3 to describe equivalent items. Again, closure or diaphragm 10' comprises a flexible member of rubber, synthetic rubber or other suitable elastomeric material. A plurality of plies **16*a*–16*f* formed of fabric strips are bonded or secured within closure 10', and the outer strip ends 17*a*–17*f* of plies 16*a*–16*f* wrapped about reinforcing member 12. However, unlike in closure or diaphragm 10, in closure or diaphragm 10', strip ends 17 of plies 16 are wrapped about reinforcing member 12 in alternating directions from alternating sides of member 12. For example, the innermost ply 16*a* extends horizontally from right to left of FIG. 4, running under the bottom side of reinforcing member 12 and wrapped in a clockwise direction over the top side thereof, overlap strip end 17*a* then extending to the right of member 12 back across the face of the closure or diaphragm. The second ply, 16*b*, extends from right to left, passing over overlap strip end 17*a*, over the top side of member 12, wrapping in a counterclockwise direction over the bottom side thereof and extending over and bonded to the primary load carrying strip portion 18*a* of ply 16*a*. The third ply, 16*c*, like the first, 16*a*, runs under the bottom side of member 12, wraps clockwise over the top side thereof, and extends to the right of member 12, overlap end 17*c* lying adjacent and bonded to the primary load carrying strip portion 18*b* of ply 16*b*. It should be noted that, when ply 16*c* is overlapped, overlap end 17*b* of ply 16*b*** is bonded to *both* primary load carrying strip portions **18*a* and 18*c*; this result obtains until one reaches the outermost strip 16*f* and overlap end 17*f*. This sequence can be repeated for however many reinforcing plies are employed in the diaphragm, the section shown in FIG. 4 illustrating six (6) such strips as in FIG. 3, but with three (3) located above and three (3) below the centerline of reinforcing member 12, instead of all six (6) lying below, or offset from, the centerline of member 12 in the prior art arrangement of FIG. 3. As with closure or diaphragm 10, closure or diaphragm 10' is clamped between two plates 13 by bolts 14 and cooperating nuts 15 (see FIG. 2**).

A closure 10' or diaphragm, as depicted in FIG. 4 may also, but is not required to, employ a central insert 21 disposed between the two innermost plies of primary load carrying strip portions **18*a* and 18*b*. Insert 21 is preferably of the same material as the flexible member of the diaphragm or closure, and is bonded to both the inner edge of reinforcing member 12 and to the insides of primary load carrying strip portions 18*a* and 18*b* as well as overlap end 17*a* of ply 16*a*. The inclusion of insert 21 divides the reinforcement for the closure or diaphragm 10' into two discrete layers, and reduces the angle through which the plies above and below insert 21 must traverse in departing from and returning to an orientation substantially parallel to the centerline of reinforcing member 12, thus reducing the tendency of adjacent primary load carrying strip portions 18 and overlap ends 17 to separate from each other under stress. An alternative to insert 21 would be to employ a strip of triangular cross-section adjacent the inner edge of the reinforcing member 12** to ensure a gradual transition back to the parallel.

The aforesaid ply overlap arrangement ensures application of force to reinforcing member 12 by primary load carrying strip portions 18 substantially along the former's centerline, thus avoiding the twisting of the prior art. Moreover, it can readily be appreciated that there are many more primary load carrying strip portion/overlap end bonds than in the prior art arrangement of FIG. 3, to be exact, ten versus one for the same number of plies 16. The resulting bond area and bond strength between adjacent load carrying strips and overlap ends is phenomenally greater, producing a much more reliable closure or diaphragm wherein the limiting factor of the closure or diaphragm's strength because that of the fabric strips and not of the strip bond(s) at the periphery of the closure or diaphragm.

It will be appreciated by one of ordinary skill in the art that a novel and unobvious ply overlap arrangement for closures and diaphragms has been invented. While described in terms of a preferred embodiment, the invention is not so limited, and many additions, deletions and modifications to the preferred embodiment may be made without departing from the spirit and scope of the claimed invention. For example, the invention may be employed with a plurality of reinforcing members or any suitable cross-sectional shape thereof; it may be employed with any layup pattern and any fabric, and with adhesive induced rather than cure-type bonding.

I claim:

1. A closure element for use in combination with a closure retaining means for closing the bore of a tubular support member of a marine platform or other similar structure located in a body of water or other fluid environment, said closing comprising:

circular flexible member means having a peripheral portion and an inner portion;

annular reinforcing member means located in the peripheral portion of the circular flexible member means; and reinforcing means contained within said flexible member means and having an inner portion and a peripheral portion, the reinforcing means comprising at least two layers, each layer comprised of fabric means and including an inner load carrying portion and an outer overlap end portion, the overlap end portion of each of said layers being wrapped about said annular reinforcing member means in the opposite direction from any adjacent layer overlap end portion, each wrapped overlap end portion extending inwardly of said annular reinforcing member means in overlaying relationship to an inner load carrying portion of at least one other layer.

2. The closure element of claim 1, wherein said fabric means layers each comprise a plurality of strips of fabric, and said overlap end portions each comprise an end of a fabric strip.

3. The closure element of claim 1, wherein said annulus reinforcing member means is asymmetrical in cross-section, and said inner load carrying portions of said layers exert a tensile force substantially aligned with a centerline of said annular reinforcing member means when said closure is stressed.

4. The closure element of claim 1, wherein said at least two layers of said reinforcing member means comprises at least three layers, and the wrapped overlap end portion of at least one of said layers is in overlaying relationship to an inner load carrying portion of at least two other layers.

5. The closure element of claim 1, further including a central insert means disposed between the two innermost layers of said at least two layers of said reinforcing means.

6. In combination, a closure and an annular closure retaining means retaining said closure therein for closing the bore of a tubular support member of an offshore platform or other similar structure located in a body of water or other fluid environment, wherein said closure comprises:

circular flexible member means having an inner portion and a peripheral portion;

annular reinforcing member means located in the peripheral portion of the circular flexible member means; and reinforcing means contained within said flexible member means and having an inner portion and a peripheral portion, the reinforcing member means comprising at least two layers, each layer comprised of fabric means and including an inner load carrying portion and an outer overlap end portion, the overlap end portion of each of said layers being wrapped about said annular reinforcing member means in the opposite direction from any adjacent layer overlap portion, each wrapped overlap end portion extending inwardly of said annular reinforcing member means and said annular closure retaining means in overlying relationship to load carrying portion of at least one other layer; and wherein said annular closure retaining means comprises:

a pair of annular flat plates releasably secured to each other and retaining the peripheral portion of said flexible member means and said annular reinforcing member therebetween, said annular closure retaining means having one of the pair of annular plates secured to the end of a tubular support member of said offshore platform or said similar structure thereby closing said bore of the tubular support member by said closure and said closure retaining means being installed thereon.

7. The closure element of claim 6, wherein said fabric means layers each comprise a plurality of strips of fabric, and said overlap end portions each comprise an end of a fabric strip.

8. The closure element of claim 6, wherein said annulus reinforcing member means is asymmetrical in cross-section, and said inner load carrying portions of said layers exert a tensile force substantially aligned with a centerline of said annular reinforcing member means when said closure is stressed.

9. The combination of claim 6, wherein said at least two layers of said reinforcing member means comprises at least three layers, and the wrapped overlap end portion of at least one of said layers is in overlaying relationship to an inner load carrying portion of at least two other layers.

10. The combination of claim 6, wherein said closure is retained in said annular closure retaining means by a means of a plurality of fasteners extending through said closure retaining means, through the circular flexible member means of said closure, through the annular reinforcing member means of said closure and through the reinforcing means of said closure.

11. The combination of claim 6, further including a central insert means disposed between the two innermost layers of said at least two layers of said reinforcing means.

* * * * *